United States Patent [19]

Bastenhof

[11] 4,161,161

[45] Jul. 17, 1979

[54] DEVICE FOR DAMPING PRESSURE WAVES IN AN INTERNAL COMBUSTION ENGINE FUEL INJECTION SYSTEM

[75] Inventor: Dirk Bastenhof, Eaubonne, France

[73] Assignee: Societe d'Etudes de Machines Thermiques S.E.M.T., Saint Denis, France

[21] Appl. No.: 767,485

[22] Filed: Feb. 10, 1977

[30] Foreign Application Priority Data

Mar. 15, 1976 [FR] France ..... 76 07337

[51] Int. Cl.[2] ..... F02M 55/02

[52] U.S. Cl. ..... 123/32 JV; 123/139 AT; 123/139 DP; 239/533.3

[58] Field of Search ..... 123/32 JV, 139 AS, 139 AT, 123/139 AA, 139 AF, 139 DP; 239/533.3; 137/625.62

[56] References Cited

U.S. PATENT DOCUMENTS

| | | | |
|---|---|---|---|
| 2,055,578 | 9/1936 | Hurst | 123/139 AS |
| 2,729,169 | 1/1956 | Nichols | 123/139 DP |
| 3,017,922 | 1/1962 | Peterson | 123/139 AS |
| 3,430,866 | 3/1969 | Guertler | 239/533.3 |
| 3,857,541 | 12/1974 | Clark | 137/625.62 |
| 4,064,855 | 12/1977 | Johnson | 123/139 AT |

FOREIGN PATENT DOCUMENTS

| | | | |
|---|---|---|---|
| 757671 | 9/1952 | Fed. Rep. of Germany | 123/139 AT |
| 888038 | 8/1953 | Fed. Rep. of Germany | 123/139 AT |
| 2306270 | 8/1974 | Fed. Rep. of Germany | 123/139 AA |
| 2461309 | 7/1975 | Fed. Rep. of Germany | 123/139 AT |

*Primary Examiner*—Charles J. Myhre
*Assistant Examiner*—Andrew W. Dolinar
*Attorney, Agent, or Firm*—Kenyon & Kenyon

[57] ABSTRACT

In a device for injecting liquid fuel in a combustion chamber of an internal combustion engine, a pressure accumulator chamber connected through a narrow passage with an injection conduit between an injection pump and an injector and intended to suppress or reduce the pressure oscillations appearing in the injection conduit at the end of an injection stage.

6 Claims, 9 Drawing Figures

DEVICE FOR DAMPING PRESSURE WAVES IN AN INTERNAL COMBUSTION ENGINE FUEL INJECTION SYSTEM

The present invention relates essentially to a device for absorbing or damping to a large extent the hydraulic pressure waves which are produced during the injection stage and more particularly at the end of the said stage, in the liquid-fuel injection system of an internal combustion engine, such as in particular, a high-power diesel engine.

It is indeed known that a diesel engine is equipped with systems of fuel injection into each cylinder, the said system comprising an injection pump which delivers a predetermined amount of liquid fuel under high pressure into a discharge or injection conduit leading to an injector mounted on the cylinder. This injector generally comprises a body containing a valve needle and a return spring pushing the valve needle to a position in which it closes the passage to one or several orifices opening into the combustion chamber. In such a system, it is the pressure of the liquid fuel delivered by the pump that acts upon the valve needle to displace the same, against the action of the return spring, to the position where it opens the passage to the injection orifices.

Such an injection system must be apt to operate as perfectly as possible within considerable speed and load ranges, with various kinds of fuel and often under poor maintenance conditions, and in the case of an engine including a large number of cylinders and therefore an equally large number of injection systems, any trouble in the operation of one of the injection systems will require the entire engine to be stopped.

The physical problems that arise in high-power diesel-engine injection systems are intricate. Indeed, the fuel pressure in the discharge conduit at the end of the injection stage is about 1000 bars in the case of an 18-cylinder diesel engine developing 500 hp per cylinder at 500 r.p.m. The duration of the injection stage must be accurately adjusted, so that the closing of the injector valve, corresponding to the end of the injection stage, has to be controlled very accurately so as to be neither too fast nor too slow. The closing of the valve is caused, on the one hand, by the action of the return spring associated with the valve needle in the injector body, and on the other hand by the pressure drop in the discharge conduit, initiated by the opening of the injection-pump fuel spill port (when uncovered by the pump plunger), resulting in a strong negative pressure wave in the discharge conduit, continued by a fuel back-flow from the injector when the non-return or check valve of the injection pump has closed. The valve needle must be moved to its closed position rapidly but not, however, too promptly in order to prevent the valve seat from subsiding. There are two kinds of forces acting on the valve needle: on the one hand, a downward force, which is the force of the return spring varying in accordance with the stiffness of the spring and under the influence of the mechanical vibrations, and on the other hand, an upward force which includes the pressure force varied by the reflections of the negative wave at the end of the discharge conduit, and the counter-pressure in the combustion chamber, which acts on the valve needle either indirectly (before the closing) or directly (after the closing).

Among such forces, the hydraulic pressure waves acting on the valve needle at the end of the injection stage constitute the most important disadvantage, and the purpose of the present invention is precisely to remedy this drawback. Indeed, the pressure fluctuations in the discharge conduit become absolutely inadmissible if they result in reducing the pressure to zero at any point of the injection system, leading to a cavitation phenomenon which, in the long run, causes the destruction of the component parts of the injection system.

Moreover, the pressure fluctuations acting on the valve needle returned to its closed position at the end of the injection stage have such values that they are apt to lift the valve needle by overcoming the return force of the spring and thereby producing a secondary injection phenomenon which it is particularly desirable to avoid.

The purpose of the invention is precisely to reduce the amplitude of such hydraulic pressure waves, at least until such time as, under any possible operating conditions, they become less than the force exerted by the return spring on the valve needle, so as to ensure that the valve needle in its closed position at the end of the injection stage will remain pressed on the valve seat, without having to increase the return force of the spring, which is already limited by the available space and the increase of which would contribute only very little to prevent the lifts of the valve needle, for, in this case, the level about which the pressure fluctuates would also increase.

To accomplish the afore-mentioned purpose, the invention provides a device for the injection of liquid fuel into an internal combustion engine such as a high-power diesel engine, including at least one injection pump for delivering a predetermined amount of fuel under high pressure into a discharge or injection conduit leading to at least one injector, the latter comprising a body containing a valve needle acted upon by a return spring and movable, under the action of the pressure of the fuel delivered into the discharge conduit, between an open position, in which the fuel is allowed to flow to at least one orifice or equivalent passage-way opening into a combustion chamber of the engine, and a closed position, in which the fuel is shut off from the said orifice or passage-way, characterized in that it comprises a chamber constituting a pressure accumulator and connected by a narrow passage to the said discharge conduit at any point thereof between the pump and the injector valve, which chamber is intended to suppress or at least greatly reduce the pressure oscillations appearing in the discharge conduit and the injector at the end of the injection of a predetermined amount of fuel into the aforesaid combustion chamber.

The device according to the invention therefore allows the afore-mentioned problems to be solved by ensuring a prompt and stable closing of the injector by the valve needle, while at the same time avoiding any notable increase in the duration of the injection or of the closing movement. Such increases in the duration of injection or of the closing step are avoided owing to the inherent property of the invention, consisting in increasing the residual pressure in the discharge or injection conduit after final closing of the injector valve needle with concomitant damping of the still existing pressure fluctuations.

According to another feature of the invention, the pressure accumulator chamber contains a free piston mounted slidingly between two predetermined end-positions within the said chamber.

Owing to this arrangement of a free piston in the accumulator chamber, the absorption of the pressure oscillations in the discharge conduit takes place more rapidly so that the presence of hydraulic pressure waves is still more efficiently prevented. The movement of a small piston displaces a larger volume within a given short time than the volume or flow rate corresponding to the flow through a small hole. This piston must be mounted untightly between the discharge conduit and the accumulator chamber, so as to allow the liquid under high pressure to pass from the discharge conduit into the said chamber.

In another respect, the air which may be present in the discharge conduit and the accumulator chamber does not raise any difficulty during the starting of the engine, for the froth or emulsion formed by the mixture of air and fuel will be drawn along by the successive injections.

The injection will be better understood and other purposes, features, details and advantages of the latter will appear more clearly as the following explanatory description proceeds with reference to the appended diagrammatic drawings given solely by way of example illustrating various, presently preferred forms of embodiment of the invention and wherein.

Figure 7:
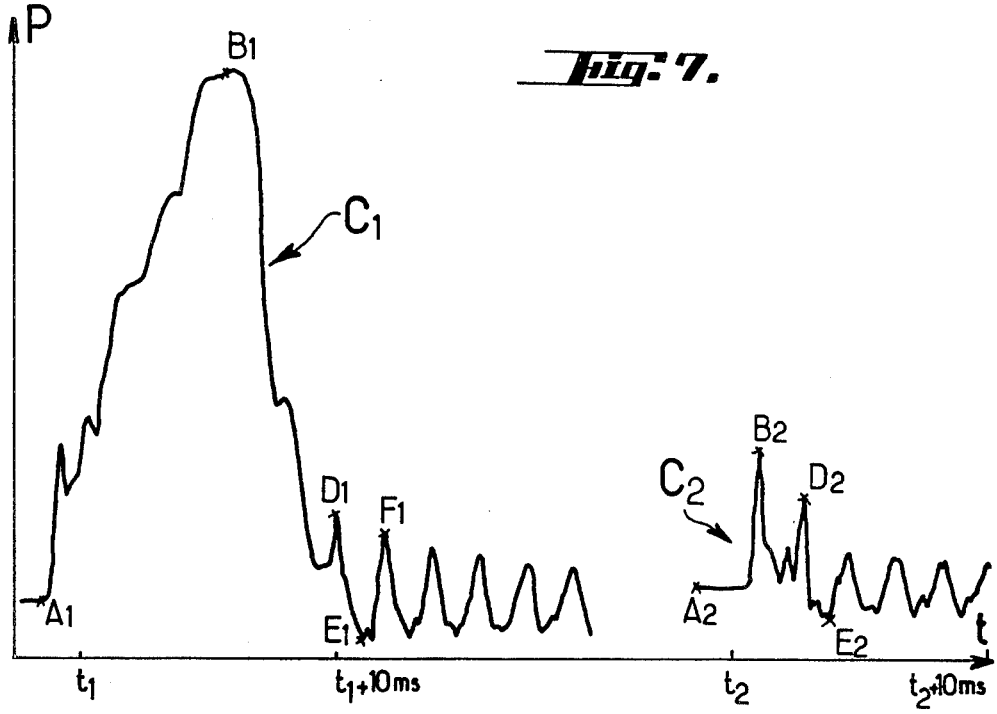
Figure 8:
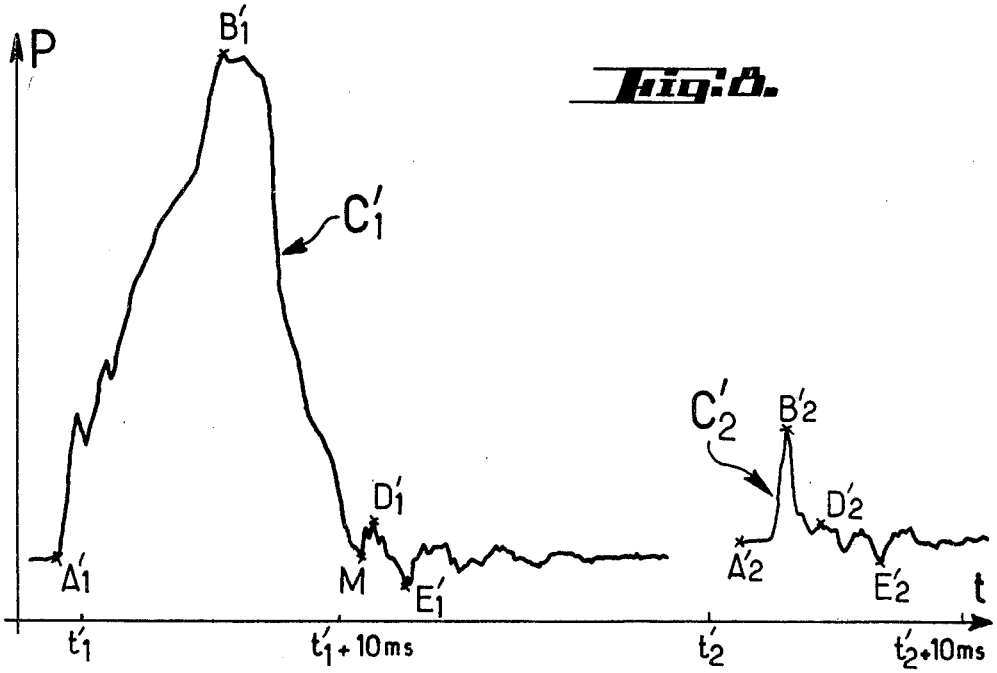
Figure 9:
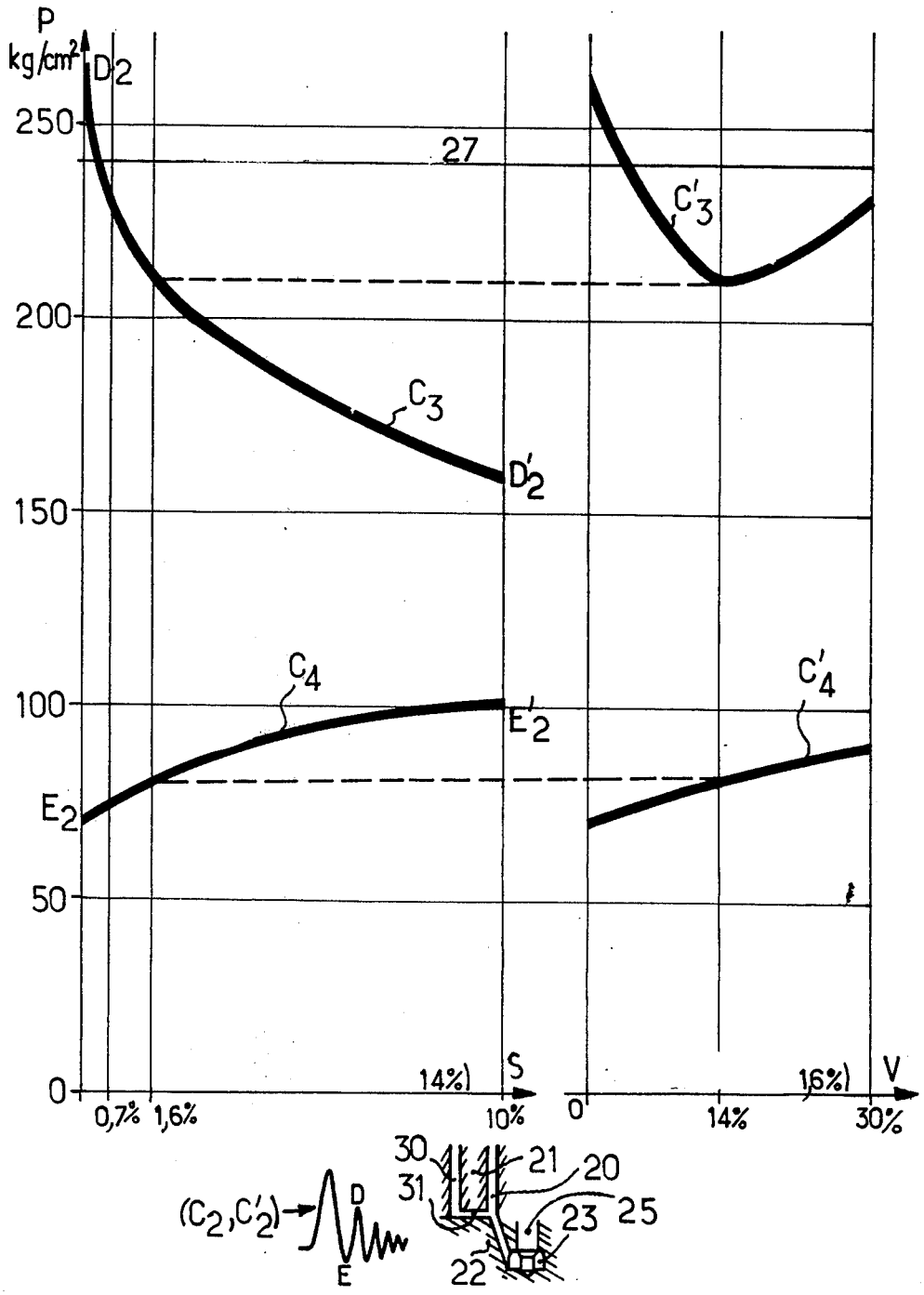

FIGS. 7 and 8 are graphical representations showing the fuel pressure in the injector as a function of time in a prior-art system and in the system according to the invention, at two rates of fuel delivery corresponding to the maximum rate of delivery and to 5% of the maximum rate of delivery of the injection pump, respectively; and FIG. 9 is a combined graphical representation including two juxtaposed graphs showing, respectively; the pressure in the injector as a function of the cross-sectional area of the narrow passage-way communicating with the accumulator chamber for a given volume of the latter (left-hand graph) and as a function of the accumulator chamber volume for a given cross-sectional area of the said passage-way (right-hand graph).

Figure 1:
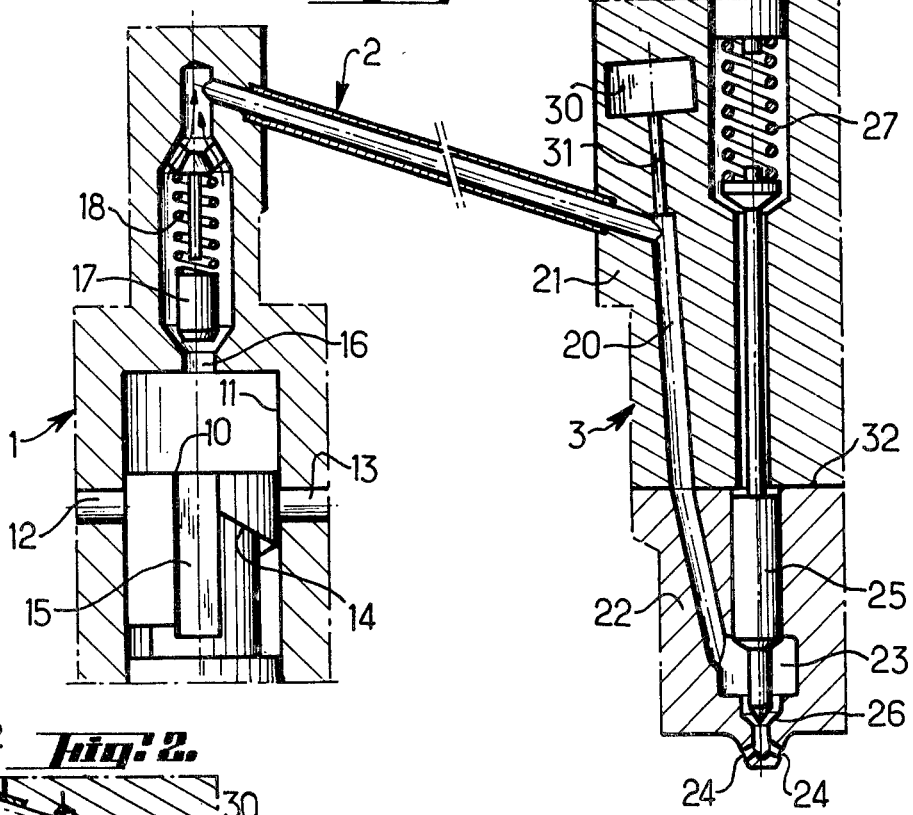
FIG. 1 is a fragmentary, longitudinal sectional view of an injection system according to the invention, including a pressure accumulator chamber.

As shown quite diagrammatically in FIG. 1, a liquid-fuel injection system for an internal combustion engine, e.g. a diesel engine, comprises essentially an injection pump 1, represented partially and diagrammatically, a discharge or injection conduit 2 for the liquid fuel delivered under pressure by the pump 1 and an injector 3 shown partially and diagrammatically.

The structure and operation of such an injection pump and such an injector are well known and will be described briefly for the sole purpose of a better understanding of the invention.

The injection pump 1 illustrated in FIG. 1 by way of example is of the constant-stroke plunger type actuated by a cam and follower system. The constant-stroke plunger 10 moves in a cylindrical chamber 11 provided with a fuel inlet port 12 and an excess fuel return or spill port 13. The piston 10 is of the type provided with a helical groove 14 on its external peripheral lateral surface and with a longitudinal slot 15 on the said periphery. It is understood that, depending on the angular position given to the plunger about its longitudinal axis by a control rack (not shown) with respect to the fuel inlet port 12 and fuel spill port 13, respectively, the amount of liquid fuel delivered by the piston 10 towards the outlet 16 of the chamber 11 will vary between a maximum value and substantially zero.

The outlet 16 of the chamber 11 of the injection pump 1 is provided with a non-return or check valve 17 acted upon by a return spring 18 and communicates with the discharge conduit 2 leading to the injector 3. Thus, for a given relative angular position of the plunger 10 of pump 1, a predetermined amount of liquid fuel is delivered under high pressure into the discharge conduit 2. The latter comprises a portion 20 extending through the injector body 21 and the nozzle body 22 and opening into an annular groove 23 communicating through orifices 24 with the combustion chamber of the associated engine cylinder. The communication between the groove 23 and the orifices 24 is selectively closed by a valve needle 25, the lower end of which is adapted to move onto and rest upon a seat 26 provided in the passage connecting the groove 23 to the orifices 24, and the upper end of which is acted upon by a return spring 27 exerting thereon a predetermined force. As is known, it is the pressure of the fuel delivered into the discharge conduit 2 that acts on the valve needle in the annular groove 23 to lift or displace the same against the action of the return spring 27 to thus open the communication between the groove 23 and the orifices 24 and cause the injection stage to begin. At the end of injection the fuel pressure rapidly drops, the valve 17 of the injection pump closes and the spring 27 presses on the valve needle 25 towards its seat 26, thus shutting off the fuel from the orifices 24 and terminating the injection.

In the prior-art system just described, however, the sharp opening of the pump ports 12 and 13 by the pump plunger 10 at the end of the injection stage produces considerable pressure oscillations in the discharge conduit 2. The value of these oscillations is such that it causes the valve needle 25 to rise by overcoming the antagonistic force of the return spring 27, resulting in an undesirable secondary injection.

The present invention allows the above drawbacks to be obviated by providing at any point in the injection system between the pump 1 and the outlet of the injector 3 a chamber constituting a pressure accumulator connected by a narrow passage with the discharge conduit 2. In the form of embodiment in FIG. 1, the chamber 30 is provided in the body 21 of the injector 3 and communicates directly through a narrow passage 31 with the portion 20 of the discharge conduit 2 provided in the body 21. According to the embodiment illustrated in FIGS. 2 and 3 and in order to simplify and therefore facilitate the manufacture of the device, the chamber 30 is advantageously constituted by a rectilinear uniform blind hole drilled from the lower transverse end-face of the injector body 21 and opening through the said face (which is preferably given a specular polish or mirror-like finish) onto the plane 32 of the joint between the body 21 and the nozzle 22 of the injector 3. In this case, the narrow connecting passage between the chamber 30 and the discharge conduit 20 advantageously consists of an elongated cavity constituting a shallow slot 31 machined in the mating upper transverse end-face of the nozzle body 22 (this space also being preferably given a specular or mirror-like polish to ensure a reliable fluid-tightness at the joint 32).

Figure 4:
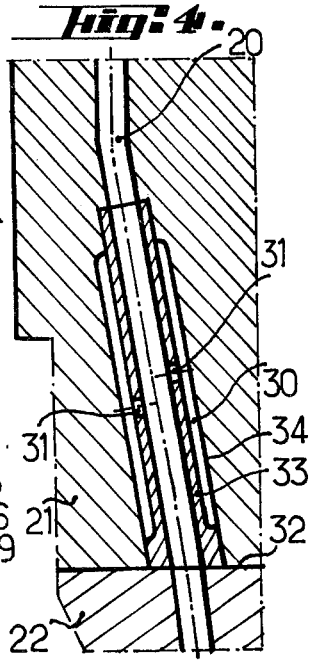
FIG. 4 is a view similar to FIG. 2 but showing still another embodiment.

According to the embodiment of FIG. 4, the discharge conduit 20 in the injector body 21 opens at the junction plane 32 through a coaxial tubular sleeve 33, the inner diameter of which is equal to that of the conduit 20 and which is inserted into a corresponding bore 34 so that its upper end is embedded in an upper end portion of the bore whereas its lower wider shouldered end is fitted in a larger-diameter portion of the bore 34 (drilled from the corresponding face of the junction plane 32). The said wider portion of the bore 34, which surrounds the narrower intermediate portion of the sleeve 33, defines with the latter an enclosed annular space 30 constituting the afore-mentioned accumulator chamber which communicates with the internal space of the sleeve (forming part of the discharge conduit) through one or several narrow passage-ways constituted by several radial orifices traversing the lateral wall of the sleeve.

Figure 5:
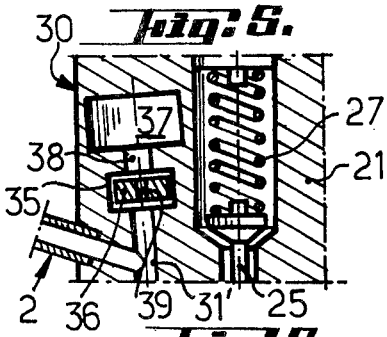
FIG. 5 is a longitudinal sectional view of the upper portion of the injector body of FIG. 1, showing another embodiment of the invention wherein the accumulator chamber is combined with a free piston.

In the embodiment according to FIG. 5, the chamber 30 comprises essentially a counter-bore or like cavity 35 into which opens a passage 31' and which contains a free piston 36, and another counter-bore or cavity 37 connected by a short passge 38 to the first counter-bore 35. The free piston 36 is traversed by a small-diameter axial passage 39.

Advantageously, the total volume of the chamber 30 consisting of the free volumes of the counter-bores 35 and 37 and by the passages 31 and 38, is comprised between about 10% and 40% of the total capacity or containing ability of the standard discharge conduit 2 normally connecting the pump 1 to the injector 3 in a prior-art system. It has indeed been found that this range of volumes is precisely the one that ensures the best results from the point of view of absorption or damping of the pressure oscillations in the discharge conduit 2. The narrow passage 31 shown in FIGS. 1 to 4, or the narrow passage 39 extending through the free piston 36 in FIGS. 5 and 6, has a cross-section which is advantageously comprised between 2% and 15% of the section of the standardized discharge conduit 2 used in the prior art. The total volume of the displacement of the free piston 36 in the first cavity 35, i.e. the product of the section of the free piston into its possible total travel is advantageously comprised between about 0.5% and 3% of the fuel volume injected by the pump 1 per stroke at maximum load.

As pointed out in connection with FIGS. 1 to 4 the pressure accumulator chamber 30, according to one form of embodiment of the invention, may not contain a free piston 36, in which case it is the passage 38, 31' or the passage-way 31 that fulfills the function of the narrow passage 39 provided in the free piston 36. However, the use of a free piston allows the hydraulic pressure oscillations developed in the discharge conduit 2 to be absorbed and compensated for more quickly.

In the embodiment illustrated in FIG. 1 or 5 the pressure accumulator chamber 30 located in the injector body 21 is substantially aligned with the portion 20 of the discharge conduit and opens directly into the said portion through the passage 31 and 31'.

Figure 6:
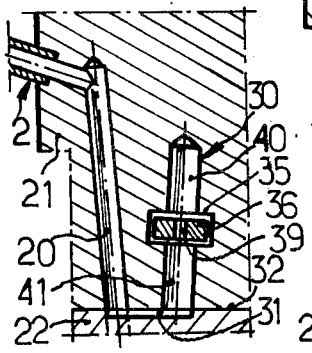
FIG. 6 is a view similar to FIG. 1, but according to still another embodiment of the invention.
Figure 3:
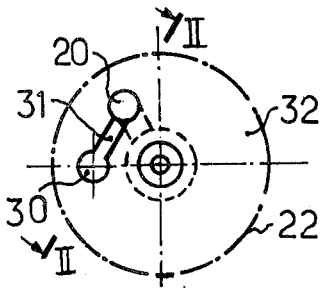
FIG. 3 is a cross-sectional view upon III—III of FIG. 2.

On the contrary, in the embodiment illustrated in FIGS. 3 and 6, the accumulator chamber 30 according to the invention is constituted by a single blind passage in the body 21 of the injector 3, which extends within the body 21 from the junction plane or mirror-polished joint 32 between the injector body 21 and the nozzle body 22. In this case, the chamber 30 therefore comprises a passage 40 and an intermediate cavity 35 containing the free piston 36 provided with a small-diameter axial passage 39.

Figure 2:
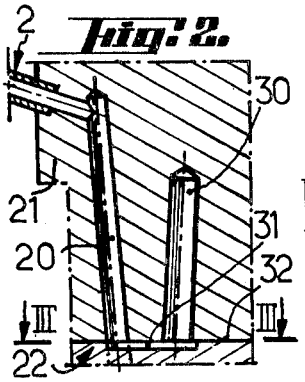
FIG. 2 is a partial sectional view of an injector body similar to that of FIG. 1 but showing in section upon II—II of FIG. 3 another embodiment of the pressure accumulator chamber according to the invention.

The chamber 30 in this form of embodiment, as in the one shown in FIGS. 2 and 3, communicates with the portion 20 of the discharge conduit 2 through a passage 31 in the form of a hollow provided in the plane upper face of the nozzle body 22 normally in contact with the corresponding plane face of the body 21 of the injector 3. Thus, the passage 31 may be, also in this case, a simple slot in the form of a hollow in the upper plane face of the nozzle body 22.

The dimensions of the chamber 30 and of the narrow passage 31 and the total volume of displacement of the free piston 36 must advantageously comply with the same conditions as those indicated in the description of the embodiment of FIG. 5.

The graphs shown in FIGS. 7 and 8 represent the variations of the injection pressure as a function of time in a prior-art system (in FIG. 7) and in a system according to the invention (FIG. 8).

These graphs relate to a high-power diesel engine comprising a large number of cylinders and developing about 500 hp per cylinder.

The graphs C1 and C'1 correspond to a fuel injection at the maximum rate of delivery of the pump whereas the graphs C1 and C'1 correspond to an injection at a rate substantially equal to about 5% of the maximum rate of delivery of the injection pump.

In FIG. 7 the graph C1 relating to a prior-art injection system and corresponding to the maximum rate of delivery of the injection pump 1 shows that the duration of the injection is about 10 milliseconds and that the injection pressure varies from 90 kg/cm$^2$ at A1 to 970 kg/cm$^2$ at B1, causing the valve needle 25 of injector 3 to rise and therefore starting the injection stage, and then, at the end of the injection stage, the pressure drops again to a low value past a peak D1 corresponding to a pressure of 240 kg/cm$^2$ before falling down again to the point E1 at a pressure of 25 kg/cm$^2$. Since, in the engine considered, the return spring 27 of the valve needle acts upon the latter with a pressure of 240 kg/cm$^2$, it is understood from graph C1 that the valve needle which closed the passage 26 between the points B1 and D1 tended to re-open it at the point D1 before closing it again at the point E1 and thereafter rising again at the point F1. In the case of graph C2 which represents the pressure variations in the same prior-art injection system, but at a rate of delivery equal to 5% of the maximum rate of delivery of the injection pump 1, the pressure during an injection stage starts at point A2 from a value of 120 kg/cm$^2$, increases to 340 kg/cm$^2$ at point B2, then diminishes again to a low value corresponding to the downward valve-closing motion of the needle 25, before passing again through the peak value D2 corresponding to a pressure of 260 kg/cm$^2$, much higher than the pressure exerted by the return spring 27 of the valve needle. The pressure thereafter drops to 70 kg/cm$^2$ at point E2 before oscillating for a certain time.

If the same injection system is provided, according to the invention, with a pressure accumulator chamber 30 of the type shown in FIGS. 2 and 3, the pressure variations during the injection stages are illustrated by graphs C'1 and C'2 shown in FIG. 8. As appears from the graph C'1 corresponding to an injection with a maximum rate of delivery of the injection pump, the pressure starts at the point A'1 from a pressure of 100 kg/cm$^2$, increases to 925 kg/cm$^2$ at the point B'1, is reduced again to 100 kg/cm$^2$ at M, then rises to 160 kg/cm$^2$ at D'1, and then falls to 55 kg/cm$^2$ at E'1. The pressure at D'1, equal to 160 kg/cm$^2$, is therefore much lower than the pressure of 240 kg/cm$^2$ exerted by the return spring 27 on the valve needle 25. The latter therefore cannot be lifted under the action of the pressure oscillations, which are considerably damped as will be seen in comparing the graphs C1 and C'1.

On the graph C'2 representing the pressure variations in a system according to the invention during an injection at a rate of fuel delivery equal to about 5% of the maximum rate of delivery of the pump, the pressure starts from 130 kg/cm$^2$ at point A'2, increases to 310 kg/cm$^2$ at pont B'2, diminishes again to 160 kg/cm$^2$ at point D'2 and then to 100 kg/cm$^2$ at point E'2. Also in this case it will be noted that the pressure oscillations at the end of the injection stage are considerably damped as compared with the corresponding oscillations of the graph C2 and, in any case, are quite lower than the pressure of 240 kg/cm$^2$ exerted on the valve needle by its return spring.

In comparing the minimum pressures at $E_1$ and $E_2$ in FIG. 7 with the minimum pressures $E'_1$ and $E'_2$, respectively, in FIG. 8, it is seen that, owing to the invention, the values of these minimum pressures are increased from 25 kg/cm$^2$ and 70 kg/cm$^2$ in FIG. 7 to 55 kg/cm$^2$ and 100 kg/cm$^2$, respectively, in FIG. 8, thus resulting in favourable conditions to oppose any tendency to cavitation.

FIG. 9 illustrates the effect of the device according, for example, to FIGS. 2 and 3 (provided with only an accumulator chamber without floating piston) upon the variation of the maximum pressure E (graphs C3 and C'3, respectively) and of the minimum pressure E (graphs C4 and C'4, respectively) of the graphs C2 and C'2, respectively, of FIGS. 7 and 8, as a function, on the one hand, of the relative cross-sectional area of the narrow passage 31 (related to the cross-sectional area of the discharge conduit 20) for a constant relative volume of 14% of the chamber 30 (related to the total capacity or containing ability of the discharge conduit 20) according to the left-hand graphical representation (graphs C3 and C4) and, on the other hand, of the relative volume V of the chamber 30 for a relative cross-sectional area of the narrow passage 31 of 1.6%. FIG. 9 corresponds to a rate of delivery of the injection pump equal to 5% of its maximum rate of delivery.

It is thus found that the mere presence of the accumulator chamber already leads to a quite satisfactory result and offers the advantage of avoiding the provision of additional members or parts in the system.

It is therefore understood that the device according to the invention allows an efficient absorption of the pressure oscillations occurring in the discharge conduit at the end of the injection stage, i.e. on the downward motion of the valve needle, without requiring the force of the return spring to be increased and without increasing the duration of the injection, or the duration of the end of the injection stage corresponding to the downward motion of the valve needle.

A very important technical advantage resulting from the invention is that the residual pressure in the discharge conduit remains at a constant optimum value irrespective of the engine running speed. This residual pressure must not be too low for this would facilitate the occurrence of the cavitation phenomenon and it must not be too high either, for it would then be likely to cause a secondary opening of the valve needle after the end of the injection stage, and moreover, it would have an influence on the moment of the beginning of the injection. The aforementioned ranges of values for the volume of the accumulator chamber and the section of the narrow passage allow precisely the residual pressure to be maintained at an adequate value, and it has surprisingly been found that this value of the residual pressure remains constant at all engine speeds, which is contrary to all expectations and to what happens when, for example, the section of the narrow passage is smaller than 1% of the section of the discharge conduit.

By generalizing the principle of the arrangement represented in FIG. 4, it may be considered that the accumulator chamber may, according to a particular embodiment, be constituted by an enclosed annular space surrounding a portion of the discharge or injection conduit or tube and communicating with the interior of the latter through one or several openings, possibly arranged in different manners through the wall of the said conduit or tube and each constituting an aforesaid narrow passage.

On the other hand, the accumulator chamber and/or the narrow passage are so arranged or designed and/or formed as to favor or allow for automatic discharge or elimination of the air filling the chamber at the beginning of the operation of the system. For example, ech said narrow passage may advantageously open, whenever possible, into the higher portion or the upper end of the accumulator chamber so as to favor the discharge of the emulsion mixture of air and fuel which is formed on starting the injection system.

Moreover, the device of the invention may be associated with injection pumps of a type or principle differing from the one described above.

The invention therefore allows a simple and efficient solution of the afore-mentioned problems encountered in the injection systems of the prior art, which are of considerable importance in the case of high-power engines.

Of course, the invention is by no means limited to the forms of embodiment described and illustrated, which have been given by way of example only. For example the aforesaid narrow passage connecting the chamber to the injection or discharge tube may be instead of an axial passage closed in the free piston, closed by an annular gap between the peripheral outer surface of the free piston and the corresponding wall of the counterbore or cavity. Also, the said narrow passage may be formed independently of the free piston.

The invention therefore comprises all means constituting technical equivalents to the means described as well as their combinations, should the latter be carried out according to its gist and within the scope of the following claims.

What is claimed is:

1. A device for injecting liquid fuel into an internal combustion engine, the device comprising an injection pump and an injector, the injector including an injector body, an injector nozzle having an injector valve seat and at least one fuel delivery orifice, an injection conduit having a portion extending through the injector body and connecting the pump to the fuel delivery orifice by way of the injector valve seat, an injector needle valve reciprocally mounted in the injector body, said device further comprising:

an accumulator chamber formed in the injector body and having a volume less than the total volume of the injection conduit and a narrow passage having a cross-section smaller than the cross-section of the injection conduit and connecting the accumulator chamber to the portion of the injection conduit which extends through the injector body, wherein the injector body has a flat junction surface, the nozzle has a flat junction surface sealingly mating with the junction surface of the injector body, the portion of the injection conduit that extends through the injector body crosses the plane of the junction surfaces into the injector nozzle, the accumulator chamber comprises a blind hole drilled into the injector body from the junction surface thereof at a location spaced from the intersection of the injection conduit with said junction surface, and the narrow passage comprises a slot in one of the junction surfaces of the injector body and the injector nozzle.

2. A device according to claim 1, wherein the said accumulator chamber contains a free piston mounted slidingly between two predetermined end-positions within the said accumulator chamber.

3. A device according to claim 2, wherein the said free piston is axially traversed by a drilled hole forming a part of the said narrow passage.

4. A device according to claim 2, wherein the total possible volume of displacement of the said free piston is comprised between about 0.5 and 3% of the volume of fuel injected per stroke at full load.

5. A device according to claim 2, wherein the said drilled hole comprises a larger-diameter cavity or counter-bore in which is accommodated said free piston.

6. A device according to claim 1 wherein the volume of the accumulator chamber is equal to approximately from 10 percent to 30 percent of the total capacity of the injection conduit, and the cross-sectional area of the narrow passage is equal to approximately from 1 percent to 15 percent of the cross-sectional area of the injection conduit.

* * * * *